United States Patent [19]

Hocker et al.

[11] Patent Number: 4,798,686

[45] Date of Patent: Jan. 17, 1989

[54] ORGANIC POLYMERS WITH ELECTRICAL PROPERTIES

[75] Inventors: Jürgen Hocker, Bergisch-Gladbach; Ludwig Rottmaier, Odenthal-Gloebusch; Klaus Reinking, Wermelskirchen; Jürgen Kirsch, Cologne; Heinz-Josef Füllmann, Leichlingen, all of Fed. Rep. of Germany

[73] Assignee: Bayer Aktiengesellschaft, Leverkusen, Fed. Rep. of Germany

[21] Appl. No.: 932,077

[22] Filed: Nov. 18, 1986

[30] Foreign Application Priority Data

Nov. 29, 1985 [DE] Fed. Rep. of Germany ..... 3542231

[51] Int. Cl.[4] ..... H01B 1/00

[52] U.S. Cl. ..... 252/500; 252/512; 252/518

[58] Field of Search ..... 252/500, 512, 518; 524/82; 523/137

[56] References Cited

U.S. PATENT DOCUMENTS 4,375,427 3/1983 Miller et al. ..... 252/512
4,397,971 8/1983 Hocker et al. ..... 524/40

FOREIGN PATENT DOCUMENTS 0034300 8/1981 European Pat. Off. .
0039829 11/1981 European Pat. Off. .
0131189 1/1985 European Pat. Off. .
3324768 1/1985 Fed. Rep. of Germany .

OTHER PUBLICATIONS

English translation of German Application No. 3324768=U.S. patent application Ser. No. 794,757=European Application No. 0131189.
English translation of European Patent Application No. 0034300=U.S. patent application Ser. No. 932,077.

*Primary Examiner*—Josephine Barr
*Attorney, Agent, or Firm*—Sprung Horn Kramer & Woods

[57] ABSTRACT

Organic polymers, for example thermoplastics, thermosetting resins, elastomers or lacquers with increased electrical conductivity, characterized by a content of sulphur-containing pyropolymers which have been obtained by pyrolysis of sulphur-containing condensation products of aromatic compounds, which optionally contain hereto-cyclic rings with O, S or N as heteroatoms and, sulphur or sulphur releasing compounds.

6 Claims, No Drawings

ORGANIC POLYMERS WITH ELECTRICAL PROPERTIES

The invention relates to organic polymers, such as plastics and lacquers, with increased electrical conductivity. This increased electrical conductivity is achieved by adding a sulphur-containing pyropolymer which has been obtained by pyrolysis of a sulphur-containing condensation product of aromatic compounds, which optionally contain heterocyclic rings with O, S or N as hetero-atoms, and sulphur or sulphur releasing compounds.

It is known that the electrical conductivity of plastics and lacquers can be increased by the addition of inorganic conductive fillers. Metals, alloys, metal oxides, metal sulphides, metallised fillers or carbon, preferably in the form of carbon black or graphite, are for example used as the inorganic conductive fillers. The fillers which increase conductivity are used in the form of powders, beads, fibres or flakes. These conductive fillers do, however, have the disadvantage that, in order to obtain the required electrical conductivity, they have to be used in quantities which cause impairment of the mechanical properties of the organic polymers.

Although quantities of only 5% by weight of high-quality and thus very expensive conductivity carbon blacks already produce an effective increase in the conductivity of the organic polymers, these additions of 5% by weight do however greatly increase the viscosity of the plastic, regardless of whether the latter is processed from a solution or in the melt, and thus greatly impair the processing properties of the plastic. This increase in viscosity can also, in individual cases, cause the special structures of conductivity carbon black which are responsible for its good conductivity to be destroyed as a result of the high shearing forces required during the processing of the organic polymer, and the conductivity-increasing effect of the carbon black is therefore also diminished.

Specific organic compounds have also already been recommended as fillers for increasing the electrical conductivity of organic polymers. Thus, for example in European Pat. No. 0,034,300, the addition of electrically conductive, acicular charge transfer complexes (radical anion salts) to organic polymers, is described. These charge transfer complexes do however have the disadvantage that they may diffuse out of the organic polymers and/or slowly decompose and that the conductivity which they produce in the organic polymers does not therefore remain constant for long periods of time.

DE-OS (German Offenlegungsschrift No.) 3,113,331 (=U.S. Pat. No. 4,397,971) describes the use of a special polyacetylene modification, so-called burr-shaped or fibrous polyacetylene. Although additions of only 0.1% by weight of this special polyacetylene modification already effectively increase the conductivity of the organic polymer, this special polyacetylene modification does however similarly to customary polyacetylenes, have the disadvantage it is not stable and that its conductivity decreases greatly on exposure to air and frequently even during the incorporation of the polyacetylene into the molten plastics.

DE-OS No. 3,324,768 discloses condensation products of aromatic compounds and sulphur compounds or sulphur-releasing compounds which possess electrical conductivity. The conductivity of these condensation products does not however suffice for use as conductive fillers in organic polymers. In addition, these condensation products have the disadvantage that the addition thereof can lead to a marked increase in the viscosity of the polymer melts, which can thus no longer be processed.

It has now been found that organic polymers which have increased electrical conductivity which remains unchanged over long periods of time, and which retain their conductivity in an unchanged form even under the effect of air, heat and shearing forces, are obtained by adding to these organic polymers a sulphur-containing pyropolymer which has been obtained by pyrolysis of a sulphur-containing condensation product of aromatic compounds, which optionally contain heterocyclic rings with O, S or N as the hetero-atoms, and sulphur or sulphur releasing compounds.

Thus, the invention relates to organic polymers with increased electrical conductivity, which are characterised in that they contain a sulphur-containing pyropolymer which has been obtained by pyrolysis of a sulphur-containing condensation product of aromatic compounds, which optionally contain heterocyclic rings with O, S or N as hetero-atoms, and sulphur or sulphur-releasing compounds.

The sulphur-containing pyropolymers to be used according to the invention are preferably obtained by condensing, in a first reaction stage, an aromatic compound with sulphur or compounds releasing sulphur, such as polysulphides, in a known manner, at temperatures of 80°–500° C., if appropriate in the presence of a solvent, and pyrolysing the sulphur-containing condensation product obtained, in a second reaction stage, at temperatures of 500°–2000° C.

The electrical conductivity of the sulphur-containing condensation products increases by several powers of ten as a result of this thermal treatment. The sulphur-containing pyropolymers obtained usually exhibit, even without having been doped (i.e. without having been oxidized or reduced), an electrical conductivity of $>10^{-2}$S/cm. They are also exceptionally stable to chemicals and heat.

The sulphur-containing condensation products to be used as starting compounds for the preparations of the sulphur-containing pyropolymers and their production is known; e.g. from EP-A2-0,131,189, EP-A1-0,039,829 and U.S. Pat. Ser. No. 4,375,427. The sulphur-containing condensation products described in EP-A2-0,131,189 are preferred because of their easy accessability.

Aromatic compounds which contain 2–9 carbocyclic rings and optionally 1–3 heterocyclic rings with O, S or N as the hetero-atoms, are particularly suitable as starting compounds for the preparation of the condensation products; the condensation products prepared from readily accessible polycondensed aromatic compounds, such as anthracene, chrysene, pyrene and the readily accessible heteroaromatic compounds, such as carbazole, are preferred. It is also possible to use mixtures of aromatic compounds, of the kind present in distillation residues of industrial products, for example from the production of anthracene, anthraquinone or bisphenol, and in distillation residues from cracking processes or from crude oil processing, as the starting compounds.

The sulphur-containing pyropolymers are obtained in the form of black compositions with a metallic gloss. They are comminuted to the desired particle size using conventional means; this particle size is usually below 600μ; preferably the particle size of the pyropolymers is in the range 0.1–100μ.

The sulphur-containing pyropolymers to be used according to the invention and their preparation are described in the earlier German Patent Application No. P 3,530,819.2.

Thermoplastics, thermosetting resins, elastomers and lacquers are suitable organic polymers whose conductivity can be increased by the addition, according to the invention, of the sulphur-containing pyropolymers.

Preferred possible thermoplastics are: polymers and copolymers of monoolefinically unsaturated monomers, for example high pressure or low pressure polyethylene, polypropylene, polyisobutylene, polyvinyl chloride, also as a copolymer with vinyl acetate, polyvinyl alcohol, polyvinyl acetate, polyvinylidene chloride, polyvinylidene fluoride, polytetrafluoroethylene, polyacrylic acid, polyacrylamide, polyacrylonitrile, polymethyl methacrylate, polyvinylcarbazole, polyvinylpyrrolidone and polystyrene; copolymers, such as ABS; polycondensates, such as polyoxymethylene, cellulose acetate, cellulose ethyl ether, cellulose hydrate, celluloid, polycarbonates, polyesters (such as polyethylene terephthalate and polybutylene terephthalate), polyphenylene oxide or mixtures thereof with polystyrene; polyphenylene sulphide, polyimides, polyester-imides, polyether-imides, polyamides, such as polyamide 6, polyamide 66 and polyamide 6,10, polyamide-imides, polyester-amides, polyhydantoins, polyparabanic acids, polysulphones, polyether-sulphones and polyether-ketones.

Thermosetting resins which can be employed are compression moulding materials or casting resins, for example reaction products of formaldehyde with phenol, cresols, urea, melamine or mixtures thereof, or casting resins of unsaturated polyesters, epoxides, polyurethanes or silicones.

Examples of suitable elastomers are natural rubber, optionally chlorinated or brominated polybutadiene, polyisoprene, isobutylene polymers, ethylene and propylene copolymers, sulphochlorinated polyethylene, elastomeric polyurethanes or silicone rubbers.

Lacquer systems which dry or crosslink at room temperature as well as stoving lacquers can be used as the lacquers whose conductivity can be increased by the addition of sulphur-containing pyropolymer according to the invention. The lacquer systems to be used at room temperature are, for example, alkyl resins, unsaturated polyester resins, polyurethane resins, epoxy resins, modified fats and oils, polymers or copolymers based on vinyl chloride, vinyl ether, vinyl ester, styrene, acrylic acid, acrylonitrile or acrylic esters and cellulose derivatives. Suitable stoving lacquers are the lacquer systems which crosslink at elevated temperature, such as, for example, polyurethanes of polyethers, polyesters as polyacrylates containing hydroxyl groups and masked polyisocyanates, melamine resins of etherified melamine/formaldehyde resins and polyethers, polyesters or polyacrylates containing hydroxyl groups, epoxy resins of polyepoxides and polycarboxylic acids, polyacrylates containing carboxyl groups and polyesters containing carboxyl groups, stoving lacquers of polyesters, polyester-imides, polyester-amide-imides, polyamide-imides, polyamides, polyhydantoins and polyparabanic acids. These stoving lacquers can as a rule be applied either as powders or from solution.

The organic polymers to be finished according to the invention can also be in the form of copolymers, polymer mixtures or polymer blends. The sulphur-containing pyropolymers can also be added to polymers which already have an intrinsic electrical conductivity, such as, for example, polyacetylene, polyparaphenylene, polythiophene, polypyrrole, polyphenylenevinylenes, polyphthalocyanines or polyanilines. The intrinsically conductive polymers can here be in non-doped or doped form. Suitable doping agents are, preferably, oxidizing agents, such as $AsF_5$, $SbCl_5$, $FeCl_3$ or halogens, or reducing agents, such as alkali metals, optionally in the form of an alkali metal naphthalide.

The conductivity of the pyropolymers to be used according to the invention can be increased even further by treatment of the pyropolymers by chemical or physical methods. Thus, for example by partial oxidation or reduction of the sulphur-containing pyropolymers, highly conductive intercalation compounds can be prepared. Suitable oxidizing agents are halogens, such as fluorine, chlorine, bromine or iodine, metal chlorides, such as $FeCl_3$, $AsF_5$, $SbCl_5$ or $SbF_5$, or oxidizing acids, such as $HNO_3$ or $H_2SO_4$. The reducing agents used are, in particular, the alkali metals and alkaline earth metals. The oxidation and reduction can also be carried out electrochemically in the presence of a suitable conductive salt.

The pyropolymers to be used according to the invention can be incorporated into the organic polymers by methods which are customary for the incorporation of fillers into organic polymers. Thus, for example, they can be mixed with thermoplastics by dry mixing and subsequent extrusion in a commercially available extruder or directly by common metering into an extruder. Preferably, pellets of the thermoplastic and the sulphur-containing pyropolymer are produced in a first stage and are then processed to the desired shaped articles in a second stage. To prepare lacquer solutions or polymer solutions, the pyropolymer can be stirred directly into the polymer solution and the mixture can then be homogenised, for example with a dissolver or a bead mill. However, it is also possible for the pyropolymer to be dispersed in a suitable solvent and, if appropriate, additionally also ground and then for the organic polymer, if appropriate dissolved in a suitable solvent, to be added and, if appropriate, for the mixture to be homogenised again with suitable apparatuses. Air thereby stirred in must of course be removed by suitable measures, for example application of a vacuum. To prepare thermosetting resins, the pyropolymer can be stirred directly into the liquid or molten mass and the mass can then be comminuted and homogenised, for example with a dissolver or a bead mill. It is also possible for the pyropolymer and the resin to be processed as a thermosetting resin to be homogenised as a solution or suspension, in which case the solvent must be removed again in a second operation, for example under reduced pressure.

The organic polymers can contain customary additives, such as fillers, pigments, antioxidants, UV stabilisers, hydrolysis stabilisers, plasticisers and or other conductivity-increasing additives in addition to the pyropolymer to be used according to the invention.

The pyropolymers to be used according to the invention are usually employed in quantities of 5–80% by weight, preferably 10–70% by weight, and particularly preferably in quantities of 20–60% by weight, based on the total weight of the conductive polymer. A considerable advantage of the pyropolymers to be used according to the invention as compared with carbon black is the possibility of also being able to incorporate quantities of more than 30% by weight, without any difficulty. Even the incorporation of 50% by weight of pyropolymer into thermoplastic materials does not pose any difficulties. On the contrary, the sulphur-containing pyropolymers to be used according to the invention have the surprising property of not only improving conductivity but also—in contrast for example to carbon black—of even improving the mechanical properties of the organic polymers, for example of polyamides. Whereas the addition of large amounts of carbon black causes deterioration of the mechanical properties of the organic polymers, for example of polyamides, an improvement of the mechanical properties of the organic polymer is achieved when adding large amounts of the polymer to be used according to the invention. This improvement of the mechanical properties occurs particularly when the pyropolymers according to the invention are incorporated into polyamides.

The pyropolymer to be used according to the invention can also be used as a black pigment, in low concentrations; however, if amounts below a certain minimum amount, which can differ according to the polymer system and processing conditions, are used the conductivity is no longer increased.

The polymer compounds according to the invention have specific conductivities of between $10^{-12}$ and 100 Siemens/cm. They can be used for the production of antistatic, semiconductive or conductive components made of plastic, films or coatings. They are used as electrodes, for example in electrolysis cells or in batteries, as heat conductors, as non-chargeable housings and for shielding electromagnetic waves.

PREPARATION OF THE PYROPOLYMERS USED IN THE EXAMPLES

Pyropolymer A:

1328 g of fluorene and 1536 g of sulphur are introduced into a 6 l ground-joint flask equipped with an anchor agitator, an air condenser, a gas offtake pipe and a thermometer. The mixture is heated, with stirring, to 250°-270° C. over a period of 90 mins. and kept at this temperature for 3 hours. Then the reaction mixture is heated to 350° C., without stirring, and kept at this temperature for 6 hours. After cooling the condensation product is ground. 2490 g of a condensation product with a metallic gloss are obtained. This is heated to 1000° C. over a period of 12 hours, in a ground-joint flask made of quartz glass and equipped with a thermometer, a gas inlet pipe and a gas offtake pipe, while nitrogen is passed over, and is kept at this temperature for 10 hours. 1323 g of a sulphur-containing pyropolymer are obtained in the form of a black composition with a metallic gloss (Specific conductivity: 14.7 S/cm; sulphur content: 7.2% by weight).

Pyropolymer B:

1780 g of anthracene and 640 g of sulphur are melted together under a nitrogen atmosphere in a 4 l ground-joint flask equipped with an anchor agitator, a thermometer, a gas inlet pipe and a gas offtake pipe and then heated to 350° C. over a period of 3 hours. The mixture is kept at this temperature for 5 hours, the stirrer being switched off after 4 hours. After cooling the condensation product is ground. 1930 g of a condensation product with a metallic gloss are obtained (sulphur content: 12.6% by weight).

This condensation product is heated to 1000° C. over a period of 12 hours in the ground-joint flask described in Example 1 and kept at this temperature for 10 hours. 1461 g of a sulphur-containing pyropolymer are obtained in the form of a composition with a metallic gloss (specific conductivity: 14.3 S/cm; sulphur content: 7.4% by weight).

Pyropolymer C:

1 kg of a liquid residue from oil cracking and 2 kg of sulphur are heated to 250° C. over a period of 24 hours in a 6 l ground-joint flask equipped with an anchor agitator, a thermometer, a gas inlet pipe and a gas offtake pipe. Then the reaction mixture is heated to 350° C. over a period of one hour and then kept at this temperature for 4 hours, without stirring. After cooling, 2384 g of a black condensation product (sulphur content: 61.5% by weight) are obtained.

2.2 kg of this product are heated to 1000° C. over a period of 4 hours in the ground-joint flask used for the preparation of pyropolymer A and kept at this temperature for 15 hours. 630 g of a sulphur-containing pyropolymer are obtained in the form of a composition with a metallic gloss (specific conductivity: 17.9 S/cm; sulphur content: 7.0% by weight).

Pyropolymer D:

1500 g of anthracene and 1500 g of sulphur are melted together under a nitrogen atmosphere in a 6 l ground-joint flask equipped with an anchor agitator, a thermometer, a gas inlet pipe and a gas offtake pipe, and then heated to 250° C. over a period of one hour and stirred at this temperature for 2.5 hours. Then the reaction mixture is heated to 250° C. over a period of one hour, with stirring, and kept at this temperature for 4 hours, without stirring. 2463 g of a condensation product with a metallic gloss are obtained (sulphur content: 42.8% by weight).

This condensation product is heated at 350° C. for 7 hours in the ground-joint flask described for the preparation of the pyropolymer A. Then it is heated to 1000° C. over a period of 6 hours and kept at this temperature for 10 hours. 1364 g of a sulphur-containing pyropolymer are obtained in the form of a composition with a metallic gloss (conductivity: 12.8 S/cm; sulphur content: 7.8% by weight).

Pyropolymer E:

832 g of anthraquinone and 2176 g of sulphur are melted under a nitrogen atmosphere in a 4 l ground-joint flask equipped with an anchor agitator, a thermometer, a gas inlet pipe and a gas offtake pipe. The reaction mixture is heated to 250° C. over a period of one hour and stirred at this temperature for 3 hours. Then the reaction mixture is heated to 350° C. over a period of one hour and kept at this temperature for 4 hours, without stirring. 2491 g of a sulphur-containing condensation product are obtained.

This product is heated at 350° C. for 7 hours in the quartz glass ground-joint flask described for the preparation of pyropolymer A. It is then heated to 1000° C. over a period of 6 hours and kept at this temperature for 15 hours. 814 g of a sulphur-containing pyropolymer are obtained in the form of a product with a metallic gloss (specific conductivity: 9.8 S/cm; sulphur content; 10.5% by weight).

Examples

EXAMPLE 1

Portions of 1 kg of a 10% by weight solution of bisphenol A polycarbonate (Makrolon 5705®) in methylene chloride are each mixed with a specific amount of pyropolymer A (particle size: 12μ). Films with a wet thickness of 1000μ are cast from the black suspensions thus obtained. The surface resistances of the antistatic polycarbonate films obtained after drying are determined (according to DIN 53482).

The following table shows the quantities of propolymer A employed and the surface resistance of the polycarbonate films containing the indicated quantities of propolymer A.

TABLE

| | Quantity of pyropolymer A employed [g] | Surface resistance of the films obtained after drying (determined according to DIN 53482) [Ω] |
|---|---|---|
| (a) | 11.1 | $1.9 \times 10^9$ |
| (b) | 25 | $9 \times 10^8$ |
| (c) | 43 | $6.9 \times 10^8$ |
| (d) | 67 | $2.1 \times 10^4$ |
| (e) | 100 | $1.3 \times 10^3$ |

Example 2

100 parts by weight of bisphenol A polycarbonate powder (Makrolon 2808 ®) are mixed with 100 parts by weight of pyropolymer A (particle size: 5–25μ) and pressed to a sheet at 240° C. under a pressure of 1440 Kp/cm². The stable sheet thus obtained has a specific conductivity of $5.4 \times 10^{-3}$ S/cm.

Example 3

100 parts by weight of pulverulent poly-(2,6-dimethyl-p-phenylene oxide) and 100 parts by weight of pyropolymer B (particle size: 5–25μ) are mixed together and the mixture is pressed into a sheet for 10 minutes at 300° C. under a pressure of 100 Kp/m². The resulting stable sheet has a specific conductivity of $2.4 \times 10^{-3}$ S/cm.

Example 4

100 parts by weight of polyparaphenylene sulphide and 100 parts by weight of pyropolymer A (particle size: 12μ) are mixed together and pressed at 300° C. under a pressure of 750 Kp/cm² for 5 minutes. The sheet thus obtained has a specific conductivity of $2.8 \times 10^{-3}$ S/cm.

Example 5

Elastomeric vinylpolybutadiene (prepared from buta-1,2-diene) is cooled to −80° C. and comminuted in a granulating machine. 55 parts by weight of this granulated material are mixed with 45 parts by weight of pyropolymer E (particle size: 5–25μ). The mixture is pressed to a sheet under a pressure of 450 Kp/cm². The elastomeric sheet has a specific conductivity of $2.4 \times 10^{31\ 1}$ S/cm.

Example 6

250 parts by weight of polypropylene are mixed with 750 parts by weight of pyropolymer A (particle size: <65μ) and processed to a strand in an extruder at 220° C. A sheet produced from this strand at 200° C. under a pressure of 500 Kp/cm² has a specific conductivity of $6.9 \times 10^{-4}$ S/cm.

Example 7

300 parts by weight of prepolymerised methyl methacrylate are mixed with 250 parts by weight of pyropolymer C (particle size: <500μ) and 100 mg of bis-(4-chlorobenzzoyl)peroxide are added and the mixture is then pressed at 160° C. under a pressure of 570 Kp/cm². The sheet thus obtained has specific conductivity of $8.7 \times 10^{-1}$ S/cm.

Example 8

50 parts by weight of a copolymer of 95% by weight of methyl methacrylate and 5% by weight of ethyl acrylate are mixed with 100 parts by weight of pyropolymer A (particle size: 500μ) and the mixture is stirred into 70 parts by weight of methyl methacrylate. 100 mg of bis-(4-chlorobenzoyl)peroxide are added to the composition thus obtained and the mixture is poured on to an aluminium sheet and then left to harden at 80° C. for 18 hours. The crude product is then pressed into a sheet by pressing for 10 minutes at 160° C. under a pressure of 566 Kp/cm². The sheet thus obtained, with a thickness of 4 mm, has a specific conductivity of $3.8 \times 10^{31\ 1}$ S/cm.

Example 9

X parts by weight of a copolymer of 95% by weight of methyl methacrylate and 5% by weight of ethyl acrylate and Y parts by weight of pyropolymer D (particle size: <25μ) are mixed together and the mixture is pressed for 10 minutes at 160° C. under a pressure of 560 Kp/cm².

The following table shows the quantities of copolymer and pyropolymer used in the individual tests and the specific conductivities of the polymer sheets obtained from these components.

TABLE

| | X [parts by weight] | Y [parts by weight] | Specific conductivity [S/cm] |
|---|---|---|---|
| (a) | 80 | 20 | $2 \times 10^{-7}$ |
| (b) | 50 | 50 | $2.8 \times 10^{-1}$ |
| (c) | 30 | 70 | 5 |

Example 10

Portions of 100 parts by weight of a 40% by weight aqueous polyurethane dispersion (DLN ® from Bayer Ag) are each stirred thoroughly with X parts by weight of pyropolymer A (particle size: <63μ). The mixtures are poured on to glass plates on which they form an elastic coating.

The following table shows the added amounts of pyropolymer A and the surface resistance of the resulting coatings obtained with these quantities.

TABLE

| | X [parts by weight] | Surface resistance of the coatings [Ω] |
|---|---|---|
| (a) | 10 | $5 \times 10^7$ |
| (b) | 20 | $1.5 \times 10^6$ |
| (c) | 25 | $5 \times 10^3$ |
| (d) | 30 | $2 \times 10^3$ |
| (e) | 50 | $1.4 \times 10^2$ |

Example 11

A sheet (dimensions: 25×25×2 mm) prepared from 100 parts by weight of polyparaphenylene sulphide and 100 parts by weight of pyropolymer A (particle size: <63μ) was provided with 2 electric contacts, coated with a polyhydantoin lacquer and covered with 50 g of water in a vessel. After applying a direct voltage of 24

V/30 V/36 V the water warms up to 47° C./53° C./56° C. Thus the sheet acted as a heating plate.

Example 12

500 g of a 10% by weight solution of a polyhydantoin (average molecular weight: 84,000 g) composed of the recurring structural unit

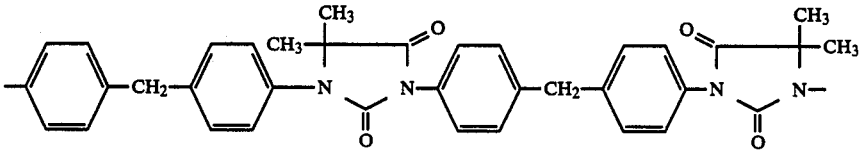

in methylene chloride are mixed with 50 g of pyropolymer B (particle size: <40μ) and the mixture is homogenised. After degassing a film with a wet thickness of 1 mm was cast from this suspension. After drying the surface resistance of this film is $5.6\times10^3$ Ω.

Example 13

100 g of a 30% strength solution of a polyhydantoin in a phenol/cresol mixture (Resistherm PH20®) are mixed with 15 g of pyropolymer C (particle size: <18μ) and the mixture is diluted with 50 g of a 1:1 mixture of xylene/phenol. After homogenisation using a dissolver wet films of a thickness of 200μ are applied to glass plates. These films are stoved for 20 minutes at 200° C. and 10 minutes at 300° C. The elastic coatings obtained in this manner have a surface resistance of $6.8\times10^4$ Ω.

Example 14

100 g of a liquid epoxy resin of technical grade hexahydrophthalic acid bisglycidyl ester (epoxide value: 0.58) and 100 g of molten hexahydrophthalic anhydride are mixed with 100 g of pyropolymer C (particle size: <63μ) and 2 g of dimethylbenzylamine are added as a catalyst. After degassing the composition is poured into a mould and heated at 80° C. for 4 hours and then at 160° C. for 16 hours. The cast resin moulding obtained in this manner has a specific conductivity of $1.8\times10^{-5}$ S/cm.

Example 15

100 g of an air-drying alkyd resin are mixed with 50 g of pyropolymer A (particle size: <12μ). After homogenisation using a dissolver glass plates are coated with the mixture. The lacquer films formed after drying overnight have a surface resistance of $6.1\times10^6$ Ω.

Example 16

50 parts by weight of pulverulent pyropolymer A (particle size: <63μ) and 50 parts by weight of polyphenylene sulphide (Ryton P 4 from Phillips Petroleum Comp.) are first mixed mechanically with one another. This mixture is dried in vacuo at 130° C. and then subjected to melt-compounding at 330° C. using a twin-screw extruder (ZSK 32 from Werner & Pfleiderer). The molten strand issuing from the extruder is granulated, after cooling. After pre-drying at 130° C. circular sheets (diameter: 800 mm, thickness: 2 mm) are injection-moulded from the resulting granules at a melt temperature of 340° C. and a mould temperature of 130° C. The electrical resistance values of the circular sheets thus obtained are:

Specific volume resistance: 110 Ω×cm

Specific surface resistance: 560 Ω

Example 17

40 parts by weight of pyropolymer A (particle size: <25μ) are incorporated into 60 parts by weight of polystyrene (Polystyrene 168N from BASF) using a double roll mill, the rolls of which are heated to 150° C. The compound obtained as a rolled sheet is then pressed into square sheets (dimensions 120×120 min; thickness: 4 mm) in a press heated to 170° C. The specific volume resistance of the sheets is 1000 Ω×cm.

Example 18

50 parts of pyropolymer B (particle size <63μ) are incorporated into 50 parts of polyamide 6 with a relative solution viscosity of 2.9 (measured using a solution of 1 g of polyamide in 100 ml of m-cresol at 25° C.) in a double roll extruder (ZSK 53 from Werner & Pfleiderer) at a stock temperature of 250° C. and a throughput of 24 kg/h. The issuing strand is cooled, granulated and dried. Then the granules are processed to specimens measuring 80×10×4 mm and 127×12.7×1.6 mm in an injection-moulding machine (A 270 from the Arburg company).

The following table shows the properties of these specimens and the properties of the specimens prepared from 100% polyamide.

No deposits of pyropolymer B were detected on any of the surfaces of the specimens either during or after the injection moulding process or after a storage period of 7 days at 70° C. in a drying oven; on the contrary the surface gloss of the specimens had not changed.

TABELLE

| | PA 6 containing pyropolymer B | PA 6 with no additives |
|---|---|---|
| heat conductivity [W/Km] | 0.566 | 0.250 |
| surface resistance [Ω] | $1.2\times10^5$ | $4\times10^{14}$ |
| bending stress 3,5% [N/mm²] | 149 | 85 |
| flexural E modulus [N/mm²] | 5708 | 2600 |
| impact strength (meth. 1 C according to ISO 180) [kJ/m²] | 33.1 | not broken |
| notch impact strength (meth. 1 A according to ISO 180) [kJ/m²] | 9.3 | 5.0 |
| fire behaviour (determined according to UL 94) | V 2 | V 2 |
| total subsequent burning time following 10 flame applications [sec] | 21 | 147 |

What is claimed is:

1. An electrically conductive organic polymer comprising an organic polymer selected from thermoplastics, thermosetting resins, elastomers and lacquers and 5–80% by weight based on the total weight of the electrically conductive polymer of a sulfur-containing pyropolymer wherein said pyropolymer is obtained by pyrolysis of a sulfur-containing condensation product of aromatic compounds and sulfur or sulfur-releasing compounds.

2. An organic polymer according to claim 1, wherein said aromatic compounds contain heterocyclic rings with O, S or N as hetero-atoms.

3. The organic polymer of claim 1, wherein the content of the sulphur-containing pyropolymer is 10–70% by weight, based on the conductive organic polymer.

4. A method of increasing the electrical conductivity of organic polymers comprising incorporating into an organic polymer selected from thermoplastics, thermosetting resins, elastomers and lacquers 5–80% by weight based on the total weight of the electrically conductive polymer of a sulfur-containing pyropolymer wherein said pyropolymer is obtained by pyrolysis of a sulfur-containing condensation product of aromatic compounds and sulfur or sulfur-releasing compounds.

5. A method according to claim 14, wherein said aromatic compounds contain heterocyclic rings with O, S or N as hetero-atoms.

6. A method according to claim 14, wherein the sulphur-containing pyropolymer is incorporated into the organic polymer in a quantity of 10–70% by weight, based on the conductive organic polymer.

* * * * *

UNITED STATES PATENT AND TRADEMARK OFFICE

CERTIFICATE OF CORRECTION

PATENT NO. : 4,798,686

DATED : January 17, 1989

INVENTOR(S) : Jurgen Hocker, et al

It is certified that error appears in the above-identified patent and that said Letters Patent is hereby corrected as shown below:

| | |
|---|---|
| Col. 3, line 56 | Delete "as polyacrylates" and substitute --or polyacrylates-- |
| Col. 6, line 8 | Delete "24 hours" and substitute --2 hours-- |
| Col. 6, line 61 | Delete "content;" and substitute --content:-- |
| Col. 7, line 54 | Delete "$2.4 \times 10^{31\ 1}$" and substitute --$2.4 \times 10^{-1}$-- |
| Col. 8, line 18 | Delete "$3.8 \times 10^{31\ 1}$" and substitute --$3.8 \times 10^{-1}$-- |

Signed and Sealed this

Tenth Day of October, 1989

*Attest:*

*Attesting Officer*

DONALD J. QUIGG

*Commissioner of Patents and Trademarks*